US012480283B2

(12) United States Patent
Hirayama et al.

(10) Patent No.: US 12,480,283 B2
(45) Date of Patent: Nov. 25, 2025

(54) FALL EVALUATION SYSTEM, FALL EVALUATION METHOD, AND WORK MACHINE

(71) Applicant: KOMATSU LTD., Tokyo (JP)

(72) Inventors: Tomoki Hirayama, Tokyo (JP); Takahiro Noyori, Tokyo (JP); Yoshihiro Iwanaga, Tokyo (JP)

(73) Assignee: KOMATSU LTD., Tokyo (JP)

( * ) Notice: Subject to any disclaimer, the term of this patent is extended or adjusted under 35 U.S.C. 154(b) by 115 days.

(21) Appl. No.: 18/549,217

(22) PCT Filed: Feb. 24, 2022

(86) PCT No.: PCT/JP2022/007630
§ 371 (c)(1),
(2) Date: Sep. 6, 2023

(87) PCT Pub. No.: WO2022/190881
PCT Pub. Date: Sep. 15, 2022

(65) Prior Publication Data

US 2024/0151007 A1 May 9, 2024

(30) Foreign Application Priority Data

Mar. 8, 2021 (JP) ..... 2021-036156

(51) Int. Cl.
*E02F 9/24* (2006.01)
*E02F 9/20* (2006.01)
*E02F 9/26* (2006.01)

(52) U.S. Cl.
CPC ..... *E02F 9/24* (2013.01); *E02F 9/2033* (2013.01); *E02F 9/26* (2013.01)

(58) Field of Classification Search
CPC . E02F 3/435; E02F 9/2033; E02F 9/24; E02F 9/26; E02F 9/264
See application file for complete search history.

(56) References Cited

U.S. PATENT DOCUMENTS

| | | | | |
|---|---|---|---|---|
| 8,768,581 | B2 * | 7/2014 | Mizuochi | E02F 9/24 701/50 |
| 9,745,727 | B2 * | 8/2017 | Gálan Benzal | E02F 9/24 |
| 10,041,225 | B2 * | 8/2018 | Mizuochi | E02F 9/2004 |
| 10,132,711 | B2 * | 11/2018 | Erie | G01M 1/30 |
| 10,858,808 | B2 * | 12/2020 | Okada | E02F 9/26 |
| 11,015,320 | B2 * | 5/2021 | Zhou | E02F 9/2228 |
| 11,319,695 | B2 * | 5/2022 | Yamamoto | G09B 19/24 |
| 11,352,761 | B2 * | 6/2022 | Suzuki | E02F 9/2285 |

(Continued)

FOREIGN PATENT DOCUMENTS

| | | |
|---|---|---|
| CN | 103597147 A | 2/2014 |
| CN | 110382787 A | 10/2019 |

(Continued)

*Primary Examiner* — Tyler J Lee
(74) *Attorney, Agent, or Firm* — GLOBAL IP COUNSELORS, LLP

(57) ABSTRACT

An energy calculation unit calculates an energy amount for each of a plurality of sides of a support polygon of a work machine in which the energy amount is required to cause the work machine to fall when the side serves as a rotation axis. An evaluation unit evaluates a possibility of the work machine falling based on the calculated energy amount for each of the sides.

8 Claims, 7 Drawing Sheets

(56) References Cited

U.S. PATENT DOCUMENTS

| | | | | |
|---|---|---|---|---|
| 11,913,193 | B2 * | 2/2024 | Ono | E02F 9/2033 |
| 2012/0232763 | A1 | 9/2012 | Mizuochi et al. | |
| 2013/0066527 | A1 | 3/2013 | Mizuochi et al. | |
| 2014/0121840 | A1 | 5/2014 | Mizuochi et al. | |
| 2017/0284056 | A1 * | 10/2017 | Mizuochi | E02F 9/2203 |
| 2019/0234048 | A1 | 8/2019 | Zhou et al. | |
| 2020/0131737 | A1 | 4/2020 | Suzuki et al. | |
| 2020/0224384 | A1 | 7/2020 | Suzuki et al. | |

FOREIGN PATENT DOCUMENTS

| | | | |
|---|---|---|---|
| CN | 110546327 | A | 12/2019 |
| CN | 110799711 | A | 2/2020 |
| JP | 5-319785 | A | 12/1993 |
| JP | 7-180192 | A | 7/1995 |
| JP | H07207711 | A | 8/1995 |
| JP | 2009-197436 | A | 9/2009 |
| JP | 6023053 | B2 | 10/2016 |
| JP | 6401087 | B2 | 9/2018 |
| JP | 2019-2242 | A | 1/2019 |
| JP | 2019190089 | A | 10/2019 |
| KR | 19990084818 | A | 12/1999 |
| WO | 2011/049079 | A1 | 4/2011 |
| WO | 2011/148946 | A1 | 12/2011 |

* cited by examiner

FALL EVALUATION SYSTEM, FALL EVALUATION METHOD, AND WORK MACHINE

CROSS-REFERENCE TO RELATED APPLICATIONS

This application is a U.S. National stage application of International Application No. PCT/JP2022/007630, filed on Feb. 24, 2022. This U.S. National stage application claims priority under 35 U.S.C. § 119(a) to Japanese Patent Application No. 2021-036156, filed in Japan on Mar. 8, 2021, the entire contents of which are hereby incorporated herein by reference.

FIELD OF THE INVENTION

The present disclosure relates to a fall evaluation system, a fall evaluation method, and a work machine.

BACKGROUND INFORMATION

PCT International Publication No. WO 2011/148946 discloses a technique for calculating a zero moment point (ZMP) of a work machine and notifying an operator of information on the possibility of falling. At the ZMP, moments in pitch axis and roll axis directions become zero. When the ZMP exists on a side of a support polygon connecting the work machine and ground contact points so as not to be concave, or inside the support polygon, it can be seen that the work machine is stably grounded.

SUMMARY

The calculation method described in PCT International Publication No. WO 2011/148946 has the possibility of determining that the possibility of falling is high, when the machine body is lifted by an inertia force of the work machine itself. For this reason, a method for evaluating the possibility of falling using an energy stability margin instead of the ZMP may be used. The energy stability margin refers to an energy required to cause falling in a certain posture state.

In the work machine, the support polygon may change depending on the work state. For example, in a work machine, since an upper swing body swings with respect to a lower undercarriage, the center-of-gravity position with respect to the support polygon changes with swing.

An object of the present disclosure is to provide a fall evaluation system, a fall evaluation method, and a work machine that can evaluate the possibility of a work machine falling in consideration of a relationship between a swing operation and a falling direction.

According to a first aspect of the present disclosure, there is provided a fall evaluation system for a work machine including work equipment, the system including: a processor. The processor includes an energy calculation unit configured to calculate an energy amount for each of a plurality of sides of a support polygon of the work machine, the energy amount being required to cause the work machine to fall when the side serves as a rotation axis, and an evaluation unit configured to evaluate a possibility of the work machine falling, based on the calculated energy amount for each of the sides.

According to a second aspect of the present disclosure, there is provided a fall evaluation method including: a step of calculating an energy amount for each of a plurality of sides of a support polygon of a work machine including work equipment, the energy amount being required to cause the work machine to fall when the side serves as a rotation axis; and a step of evaluating a possibility of the work machine falling, based on the calculated energy amount for each of the sides.

According to a third aspect of the present disclosure, there is provided a work machine including: an undercarriage; a swing body that is rotatably supported by the undercarriage; work equipment attached to the swing body; and a processor. The processor includes a center-of-gravity position calculation unit configured to calculate a center-of-gravity position of the work machine, an energy calculation unit configured to calculate an energy amount for each of a plurality of sides of a support polygon of the undercarriage based on the center-of-gravity position of the work machine, the energy amount being required to cause the work machine to fall when the side serves as a rotation axis, and an evaluation unit configured to evaluate a possibility of the work machine falling, based on the calculated energy amount for each of the sides.

According to the above aspects, the possibility of the work machine falling can be evaluated in consideration of a relationship between a swing operation and a falling direction.

DETAILED DESCRIPTION OF EMBODIMENT(S)

First Embodiment

Configuration of Work Machine 100

Hereinafter, embodiments will be described in detail with reference to the drawings.

Figure 1:
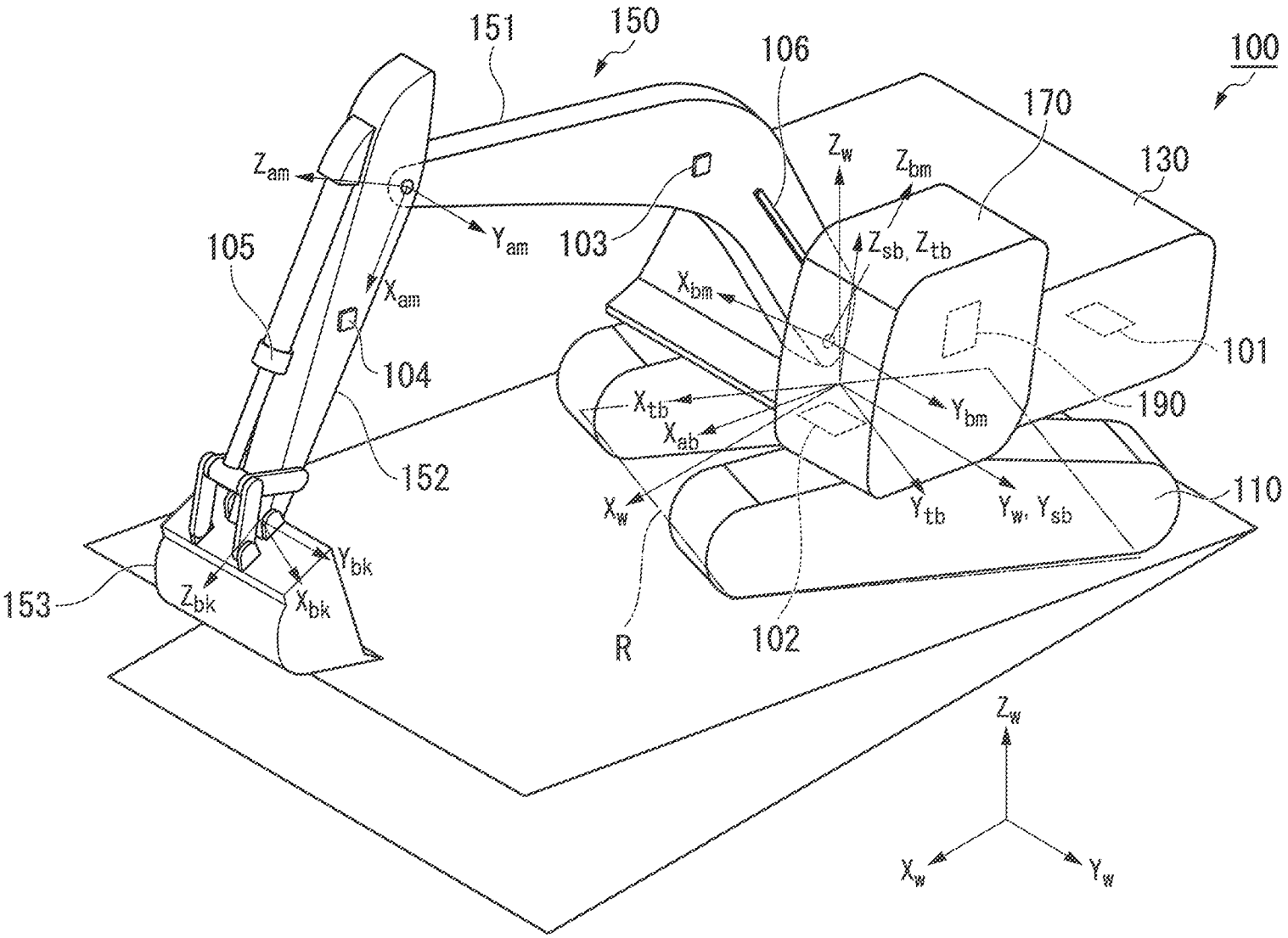
FIG. 1 is a schematic view showing a configuration of a work machine according to a first embodiment.

FIG. 1 is a schematic view showing a configuration of a work machine according to a first embodiment. The work machine according to the first embodiment is, for example, a hydraulic excavator. A work machine 100 includes an undercarriage 110, a swing body 130, work equipment 150, a cab 170, and a control device 190.

The undercarriage 110 supports the work machine 100 in a travelable manner. The undercarriage 110 is, for example, a pair of left and right endless tracks. The pair of endless tracks are provided parallel to and symmetrical with respect to a straight line extending in a traveling direction. Therefore, a support polygon represented by a convex hull related to ground contact points of the undercarriage 110 according to the first embodiment is a rectangle. The convex hull refers to the smallest convex polygon encompassing all specific points. The specific points are, for example, points where crawler belts and the ground come into contact with each other. Hereinafter, the rectangle that is a convex hull related to the ground contact points of the undercarriage 110 is referred to as a support rectangle R.

The swing body 130 is supported by the undercarriage 110 so as to be swingable around a swing center.

The work equipment 150 is supported on a front portion of the swing body 130 so as to be drivable in an up-down direction. The work equipment 150 is driven by hydraulic pressure. The work equipment 150 includes a boom 151, an arm 152, and a bucket 153. A proximal end portion of the boom 151 is rotatably attached to the swing body 130. A proximal end portion of the arm 152 is rotatably attached to a distal end portion of the boom 151. A proximal end portion of the bucket 153 is rotatably attached to a distal end portion of the arm 152. Here, a portion of the swing body 130, to which the work equipment 150 is attached, is referred to as the front portion. In addition, a portion of the swing body 130 opposite to the front portion is referred to as a rear portion, a portion of the swing body 130 on the left side of the front portion is referred to as a left portion, and a portion of the swing body 130 on the right side of the front portion is referred to as a right portion.

The cab 170 is provided at the front portion of the swing body 130. In the cab 170, an operation device that allows an operator to operate the work machine 100 and an alarm device for notifying the operator of a fall risk are provided. The alarm device according to the first embodiment notifies of a fall risk via a speaker and a display device.

The control device 190 controls the undercarriage 110, the swing body 130, and the work equipment 150 based on an operation of the operation device by the operator. The control device 190 is provided, for example, inside the cab 170.

The work machine 100 includes a plurality of sensors for detecting a work state of the work machine 100. Specifically, the work machine 100 includes an inclination detector 101, a swing angle sensor 102, a boom angle sensor 103, an arm angle sensor 104, a bucket angle sensor 105, and a payload meter 106.

The inclination detector 101 measures an acceleration and an angular velocity of the swing body 130, and detects an inclination (for example, roll angle and pitch angle) of the swing body 130 with respect to a horizontal plane based on the measurement result. The inclination detector 101 is installed, for example, below the cab 170. An exemplary example of the inclination detector 101 is an inertial measurement unit (IMU).

The swing angle sensor 102 is provided at the swing center of the swing body 130, and detects a swing angle of the undercarriage 110 and the swing body 130. The measurement value of the swing angle sensor 102 indicates zero when the directions of the undercarriage 110 and the swing body 130 coincide with each other.

The boom angle sensor 103 detects a boom angle that is a rotation angle of the boom 151 with respect to the swing body 130. The boom angle sensor 103 may be an IMU attached to the boom 151. In this case, the boom angle sensor 103 detects a boom angle based on an inclination of the boom 151 with respect to the horizontal plane and on the inclination of the swing body measured by the inclination detector 101. The measurement value of the boom angle sensor 103 indicates zero when the direction of a straight line passing through a proximal end and a distal end of the boom 151 coincides with a front-rear direction of the swing body 130. The boom angle sensor 103 according to another embodiment may be a stroke sensor attached to a boom cylinder. In addition, the boom angle sensor 103 according to another embodiment may be an angle sensor provided on a pin connecting the swing body 130 and the boom 151.

The arm angle sensor 104 detects an arm angle that is a rotation angle of the arm 152 with respect to the boom 151. The arm angle sensor 104 may be an IMU attached to the arm 152. In this case, the arm angle sensor 104 detects an arm angle based on an inclination of the arm 152 with respect to the horizontal plane and on the boom angle measured by the boom angle sensor 103. The measurement value of the arm angle sensor 104 indicates zero when the direction of a straight line passing through a proximal end and a distal end of the arm 152 coincides with the direction of the straight line passing through the proximal end and the distal end of the boom 151. The arm angle sensor 104 according to another embodiment may be a stroke sensor that is attached to an arm cylinder to calculate an angle. The arm angle sensor 104 may be a rotation sensor provided on a pin connecting the boom 151 and the arm 152.

The bucket angle sensor 105 detects a bucket angle that is a rotation angle of the bucket 153 with respect to the arm 152. The bucket angle sensor 105 may be a stroke sensor provided in a bucket cylinder for driving the bucket 153. In this case, the bucket angle sensor 105 detects a bucket angle based on a stroke amount of the bucket cylinder. The measurement value of the bucket angle sensor 105 indicates zero when the direction of a straight line passing through a proximal end and teeth of the bucket 153 coincides with the direction of the straight line passing through the proximal end and the distal end of the arm 152. The bucket angle sensor 105 according to another embodiment may be an angle sensor provided on a pin connecting the arm 152 and the bucket 153. In addition, the bucket angle sensor 105 according to another embodiment may be an IMU attached to the bucket 153.

The payload meter 106 measures the weight of a load held by the bucket 153. For example, the payload meter 106 measures a bottom pressure of the cylinder of the boom 151, and converts the measured pressure into the weight of the load. In addition, for example, the payload meter 106 may be a load cell.

Configuration of Control Device 190

Figure 2:
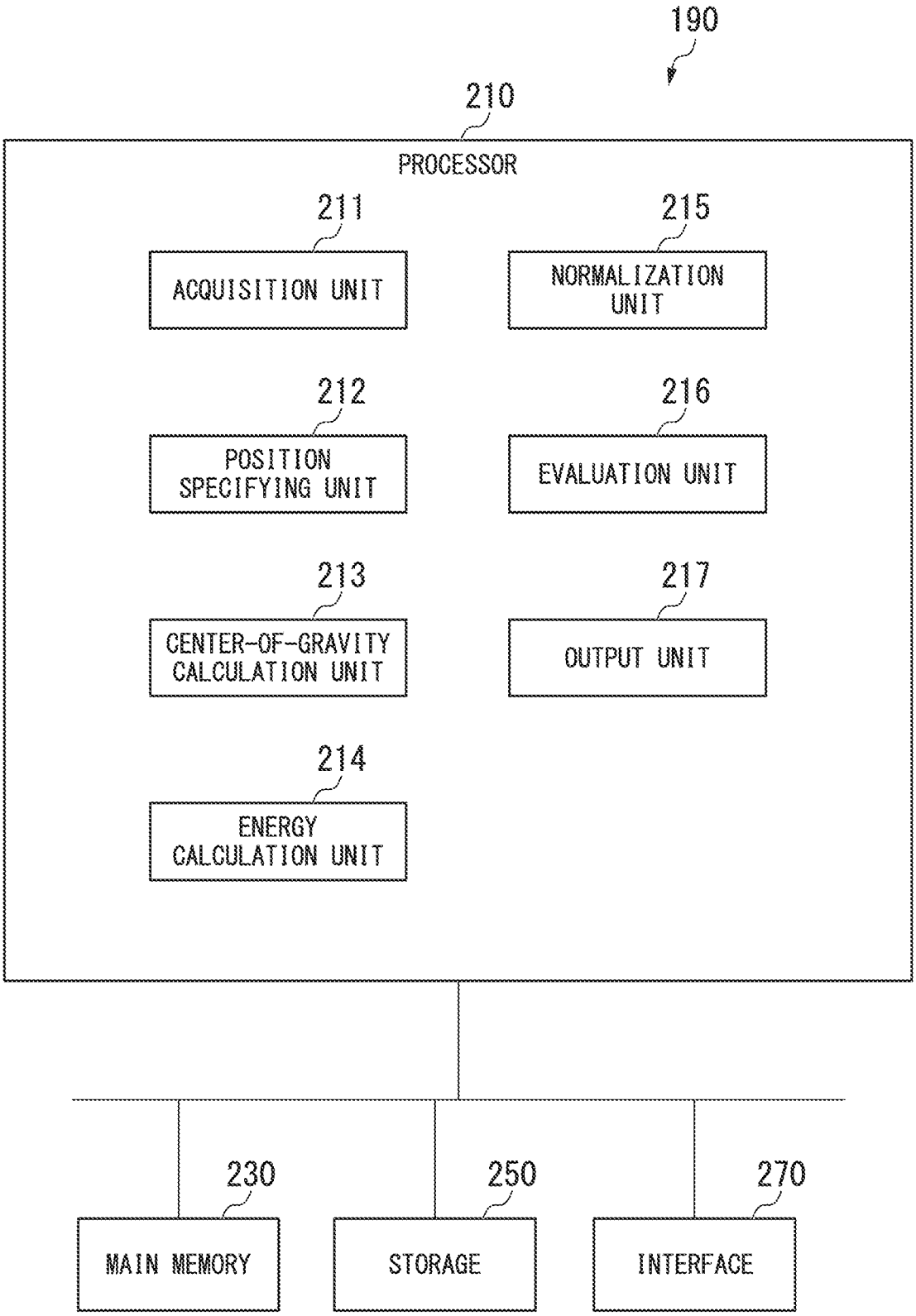
FIG. 2 is a schematic block diagram showing a configuration of a control device according to the first embodiment.

FIG. 2 is a schematic block diagram showing a configuration of the control device 190 according to the first embodiment.

The control device 190 is a computer including a processor 210, a main memory 230, a storage 250, and an interface 270.

The storage 250 is a non-transitory physical storage medium. Exemplary examples of the storage 250 include magnetic disks, optical disks, magneto-optical disks, semiconductor memories, and the like. The storage 250 may be an internal medium that is directly connected to a bus of the control device 190, or may be an external medium connected to the control device 190 via the interface 270 or a communication line. The storage 250 stores a program for controlling the work machine 100.

The program may be intended to realize some of functions to be performed by the control device 190. For example, the program may perform the functions in combination with another program that is already stored in the storage 250 or in combination with another program installed in another device. In another embodiment, the control device 190 may include a custom large scale integrated circuit (LSI), such as a programmable logic device (PLD), in addition to the above configuration or instead of the above configuration. Exemplary examples of the PLD include a programmable array logic (PAL), a generic array logic (GAL), a complex programmable logic device (CPLD), and a field programmable gate array (FPGA). In this case, some or all of the functions to be realized by the processor may be realized by the integrated circuit.

The storage 250 records geometry data representing the dimensions and center-of-gravity positions of the undercarriage 110, the swing body 130, the boom 151, the arm 152, and the bucket 153, and the weights of the undercarriage 110, the swing body 130, the boom 151, the arm 152, and the bucket 153. The geometry data represents the position of an object in a predetermined coordinate system. As the coordinate system according to the first embodiment, there exists a world coordinate system and a local coordinate system. The world coordinate system is an orthogonal coordinate system represented by a $Z_w$ axis extending in a vertical direction and an $X_w$ axis and a $Y_w$ axis orthogonal to the $Z_w$ axis. The local coordinate system is an orthogonal coordinate system with a reference point of an object as an origin.

The geometry data of the undercarriage 110 indicates the center-of-gravity position ($x_{tb_com}$, $y_{tb_com}$, $z_{tb_com}$) of the undercarriage 110 in an undercarriage coordinate system that is a local coordinate system, and a length L, a width w, and a height h of the endless tracks. The undercarriage coordinate system is composed of an $X_{tb}$ axis extending in the front-rear direction, a $Y_{tb}$ axis extending in a left-right direction, and a $Z_{tb}$ axis extending in the up-down direction with the swing center of the undercarriage 110 as a reference.

The geometry data of the swing body 130 indicates a position ($x_{bm}$, $y_{bm}$, $z_{bm}$) of the pin supporting the boom 151 of the swing body 130, in a swing body coordinate system that is a local coordinate system, a position ($x_{tb}$, $y_{tb}$, $z_{tb}$) of the origin of the undercarriage coordinate system, and a center-of-gravity position ($x_{sb_com}$, $y_{sb_com}$, $z_{sb_com}$) of the swing body 130. The swing body coordinate system is composed of an $X_{sb}$ axis extending in the front-rear direction, a $Y_{sb}$ axis extending in the left-right direction, and a $Z_{sb}$ axis extending in the up-down direction with the swing center of the swing body 130 as a reference.

The geometry data of the boom 151 indicates a position ($x_{am}$, $y_{am}$, $z_{am}$) of the pin supporting the arm 152, in a boom coordinate system that is a local coordinate system, and a center-of-gravity position ($x_{bm_com}$, $y_{bm_com}$, $z_{bm_com}$) of the boom 151. The boom coordinate system is composed of an $X_{bm}$ axis extending in a longitudinal direction, a $Y_{bm}$ axis extending in a direction in which the pin extends, the pin connecting the boom 151 and the swing body 130, and a $Z_{bm}$ axis orthogonal to the $X_{bm}$ axis and $Y_{bm}$ axis with the position of the pin as a reference.

The geometry data of the arm 152 indicates a position ($x_{bk}$, $y_{bk}$, $z_{bk}$) of the pin supporting the bucket 153, in an arm coordinate system that is a local coordinate system, and a center-of-gravity position ($x_{am_com}$, $y_{am_com}$, $z_{am_com}$) of the arm 152. The arm coordinate system is composed of an $X_{am}$ axis extending in a longitudinal direction, a Yarn axis extending in a direction in which the pin extends, the pin connecting the arm 152 and the boom 151, and a $Z_{am}$ axis orthogonal to the $X_{am}$ axis and the $Y_{am}$ axis with the position of the pin as a reference.

The geometry data of the bucket 153 includes a tooth position ($x_{ed}$, $y_{ed}$, $z_{ed}$) of the bucket 153 in a bucket coordinate system that is a local coordinate system, a center-of-gravity position ($x_{bk_com}$, $y_{bm_com}$, $z_{bk_com}$) of the bucket 153, and a center-of-gravity position ($z_{pl_com}$, $y_{pl_com}$, $z_{pl_com}$) of the load. The bucket coordinate system is composed of an $X_{bk}$ axis extending in the direction of the teeth, a $Y_{bk}$ axis extending in a direction in which the pin extends, the pin connecting the bucket 153 and the arm 152, and a $Z_{bk}$ axis orthogonal to the $X_{bk}$ axis and the $Y_{bk}$ axis with the position of the pin as a reference.

Software Configuration

The processor 210 functions as an acquisition unit 211, a position specifying unit 212, a center-of-gravity calculation unit 213, an energy calculation unit 214, a normalization unit 215, an evaluation unit 216, and an output unit 217 by executing the program.

The acquisition unit 211 acquires measurement values from the inclination detector 101, the swing angle sensor 102, the boom angle sensor 103, the arm angle sensor 104, the bucket angle sensor 105, and the payload meter 106.

The position specifying unit 212 specifies a center-of-gravity position of each part of the work machine 100 based on the various measurement values acquired by the acquisition unit 211 and on the geometry data recorded in the storage 250. Specifically, the position specifying unit 212 specifies center-of-gravity positions of the undercarriage 110, the swing body 130, the boom 151, the arm 152, the bucket 153, and the load in the world coordinate system in the following procedures.

The position specifying unit 212 generates a swing body-world transformation matrix $T^{sb}{}_w$ for transforming from the swing body coordinate system to the world coordinate system using the following Equation (1), based on the measurement values of a pitch angle $\theta_p$ and a roll angle $\theta_r$ acquired by the acquisition unit 211. The swing body-world transformation matrix $T^{sb}{}_w$ is represented by the product of a rotation matrix that causes a rotation around the $Y_{sb}$ axis by the pitch angle $\theta_p$ and a rotation matrix that causes a rotation around the $X_{sb}$ axis by the roll angle $\theta_r$.

Equation 1

$$T_w^{sb} = \begin{bmatrix} \cos\theta_p & 0 & \sin\theta_p & 0 \\ 0 & 1 & 0 & 0 \\ -\sin\theta_p & 0 & \cos\theta_p & 0 \\ 0 & 0 & 0 & 1 \end{bmatrix} \begin{bmatrix} 1 & 0 & 0 & 0 \\ 0 & \cos\theta_r & -\sin\theta_r & 0 \\ 0 & \sin\theta_r & \cos\theta_r & 0 \\ 0 & 0 & 0 & 1 \end{bmatrix} \quad (1)$$

The position specifying unit 212 generates an undercarriage-swing body transformation matrix $T^{tb}{}_{sb}$ for transforming from the undercarriage coordinate system to the swing body coordinate system using the following Equation (2), based on the measurement value of a swing angle $\theta_s$ of the undercarriage 110 and the swing body 130 acquired by the acquisition unit 211 and on the geometry data of the swing body 130. The undercarriage-swing body transformation matrix $T^{tb}{}_{sb}$ causes a rotation around the $Z_{tb}$ axis by the pitch angle $\theta_p$, and causes a parallel translation by a deviation ($x_{tb}$, $y_{tb}$, $z_{tb}$) between the origin of the swing body coordinate system and the origin of the undercarriage coordinate system. In addition, the position specifying unit 212 generates an undercarriage-world transformation matrix $T^{tb}{}_w$ for transforming from the undercarriage coordinate system to the world coordinate system by obtaining the product of the swing body-world transformation matrix $T^{sb}{}_w$ and the undercarriage-swing body transformation matrix $T^{tb}{}_{sb}$.

Equation 2

$$T_{sb}^{tb} = \begin{bmatrix} \cos\theta_s & -\sin\theta_s & 0 & x_{tb} \\ \sin\theta_s & \cos\theta_s & 0 & y_{tb} \\ 0 & 0 & 1 & z_{tb} \\ 0 & 0 & 0 & 1 \end{bmatrix} \quad (2)$$

The position specifying unit 212 generates a boom-swing body transformation matrix $T^{bm}{}_{sb}$ for transforming from the boom coordinate system to the swing body coordinate system using the following Equation (3), based on the measurement value of a boom angle $\theta_{bm}$ acquired by the acquisition unit 211 and on the geometry data of the swing body 130. The boom-swing body transformation matrix ($T^{bm}{}_{sb}$) causes a rotation around the $Y_{bm}$ axis by the boom angle $\theta_{bm}$, and causes a parallel translation by a deviation ($x_{bm}$, $y_{bm}$, $z_{bm}$) between the origin of the swing body coordinate system and the origin of the boom coordinate system. In addition, the position specifying unit 212 generates a boom-world transformation matrix $T^{bm}{}_{w}$ for transforming from the boom coordinate system to the world coordinate system by obtaining the product of the swing body-world transformation matrix $T^{sb}{}_{w}$ and the boom-swing body transformation matrix $T^{bm}{}_{sb}$.

Equation 3

$$T_{sb}^{bm} = \begin{bmatrix} \cos\theta_{bm} & 0 & \sin\theta_{bm} & x_{bm} \\ 0 & 1 & 0 & y_{bm} \\ -\sin\theta_{bm} & 0 & \cos\theta_{bm} & z_{bm} \\ 0 & 0 & 0 & 1 \end{bmatrix} \tag{3}$$

The position specifying unit 212 generates an arm-boom transformation matrix $T^{am}{}_{bm}$ for transforming from the arm coordinate system to the boom coordinate system using the following Equation (4), based on the measurement value of an arm angle Gam acquired by the acquisition unit 211 and on the geometry data of the boom 151. The arm-boom transformation matrix $T^{am}{}_{bm}$ causes a rotation around the $Y_{am}$ axis by the arm angle $\theta_{am}$, and causes a parallel translation by a deviation ($x_{am}$, $y_{am}$, $z_{am}$) between the origin of the boom coordinate system and the origin of the arm coordinate system. In addition, the position specifying unit 212 generates an arm-world transformation matrix $T^{am}{}_{w}$ for transforming from the arm coordinate system to the world coordinate system by obtaining the product of the boom-world transformation matrix $T^{bm}{}_{w}$ and the arm-boom transformation matrix $T^{am}{}_{bm}$.

Equation 4

$$T_{bm}^{am} = \begin{bmatrix} \cos\theta_{am} & 0 & \sin\theta_{am} & x_{am} \\ 0 & 1 & 0 & y_{am} \\ -\sin\theta_{am} & 0 & \cos\theta_{am} & z_{am} \\ 0 & 0 & 0 & 1 \end{bmatrix} \tag{4}$$

The position specifying unit 212 generates a bucket-arm transformation matrix $T^{bk}{}_{am}$ for transforming from the bucket coordinate system to the arm coordinate system using the following Equation (5), based on the measurement value of a bucket angle $\theta_{bk}$ acquired by the acquisition unit 211 and on the geometry data of the arm 152. The bucket-arm transformation matrix $T^{bk}{}_{am}$ causes a rotation around the $Y_{bk}$ axis by the bucket angle $\theta_{bk}$, and causes a parallel translation by a deviation ($x_{bk}$, $y_{bk}$, $z_{bk}$) between the origin of the arm coordinate system and the origin of the bucket coordinate system. In addition, the position specifying unit 212 generates a bucket-world transformation matrix $T^{bk}{}_{w}$ for transforming from the bucket coordinate system to the world coordinate system by obtaining the product of the arm-world transformation matrix $T^{am}{}_{w}$ and the bucket-arm transformation matrix $T^{bk}{}_{am}$.

Equation 5

$$T_{am}^{bk} = \begin{bmatrix} \cos\theta_{bk} & 0 & \sin\theta_{bk} & x_{bk} \\ 0 & 1 & 0 & y_{bk} \\ -\sin\theta_{bk} & 0 & \cos\theta_{bk} & z_{bk} \\ 0 & 0 & 0 & 1 \end{bmatrix} \tag{5}$$

The position specifying unit 212 transforms the relative position ($x_{tb_com}$, $y_{tb_com}$, $qZ_{tb_com}$) of the center of gravity of the undercarriage 110 indicated by the geometry data of the undercarriage 110, into an absolute position $T^{tb_com}{}_{w}$ using the undercarriage-world transformation matrix $T^{tb}{}_{w}$. The position specifying unit 212 transforms the relative position ($x_{sb_com}$, $y_{sb_com}$, $z_{sb_com}$) of the center of gravity of the swing body 130 indicated by the geometry data of the swing body 130, into an absolute position $T^{sb_com}{}_{w}$ using the swing body-world transformation matrix $T^{sb}{}_{w}$. The position specifying unit 212 transforms the relative position ($x_{bm_com}$, $y_{bm_com}$, $z_{bm_com}$) of the center of gravity of the boom 151 indicated by the geometry data of the boom 151, into an absolute position $T^{bm_com}{}_{w}$ using the boom-world transformation matrix $T^{bm}{}_{w}$. The position specifying unit 212 transforms the relative position ($x_{am_com}$, $y_{am_com}$, $z_{am_com}$) of the center of gravity of the arm 152 indicated by the geometry data of the arm 152, into an absolute position $T^{am_com}{}_{w}$ using the arm-world transformation matrix $T^{am}{}_{w}$. The position specifying unit 212 transforms the relative position ($x_{bk_com}$, $y_{bk_com}$, $z_{bk_com}$) of the center of gravity of the bucket 153 indicated by the geometry data of the bucket 153, into an absolute position $T^{bk_com}{}_{w}$ using the bucket-world transformation matrix $T^{bk}{}_{w}$. The position specifying unit 212 transforms the relative position ($x_{pl_com}$, $y_{pl_com}$, $z_{pl_com}$) of the center of gravity of the load indicated by the geometry data of the bucket 153, into an absolute position $T^{bk_com}{}_{w}$ using the bucket-world transformation matrix $T^{bk}{}_{w}$.

The center-of-gravity calculation unit 213 calculates a center-of-gravity position of the entirety of the work machine 100 based on the center-of-gravity position of each part specified by the position specifying unit 212 and on the weight of each part. Specifically, the center-of-gravity calculation unit 213 obtains an affine matrix $T^{com}{}_{w'}$ using the following Equation (6), based on a weight $m_{tb}$ of the undercarriage 110, a weight $m_{sb}$ of the swing body 130, a weight $m_{bm}$ of the boom 151, a weight main of the arm 152, and a weight $m_{bk}$ of the bucket 153 that are already known, and on a measurement value $m_{pl}$ of the payload meter 106, and calculates a center-of-gravity position $T^{com}{}_{w}$ of the entirety of the work machine 100 from the affine matrix $T^{com}{}_{w'}$.

Equation 6

$$T_{w}^{com'} = \frac{m_{tb}T_{w}^{tb_com} + m_{sb}T_{w}^{sb_com} + m_{bm}T_{w}^{bm_com} + m_{am}T_{w}^{am_com} + m_{bk}T_{w}^{bk_com} + m_{pl}T_{w}^{pl_com}}{m_{tb} + m_{sb} + m_{bm} + m_{am} + m_{bk} + m_{pl}} \tag{6}$$

The center-of-gravity calculation unit 213 obtains the 4×4 affine matrix $T^{com}{}_{w'}$ as shown in the following Equation (7), through the calculation of Equation (6).

Equation 7

$$T_w^{com'} = \begin{bmatrix} a & b & c & x_{com'} \\ d & e & f & y_{com} \\ g & h & i & z_{com} \\ 0 & 0 & 0 & 1 \end{bmatrix} \tag{7}$$

The center-of-gravity calculation unit 213 calculates the center-of-gravity position $T^{com}{}_w$ of the entirety of the work machine 100 as shown in Equation (8), by extracting a translational component of the obtained affine matrix $T^{com}{}_{w'}$, namely, by replacing a rotational component of the affine matrix $T^{com}{}_{w'}$ with an unit matrix.

Equation 8

$$T_w^{com} = \begin{bmatrix} 1 & 0 & 0 & x_{com'} \\ 0 & 1 & 0 & y_{com} \\ 0 & 0 & 1 & z_{com} \\ 0 & 0 & 0 & 1 \end{bmatrix} \tag{8}$$

Figure 3:
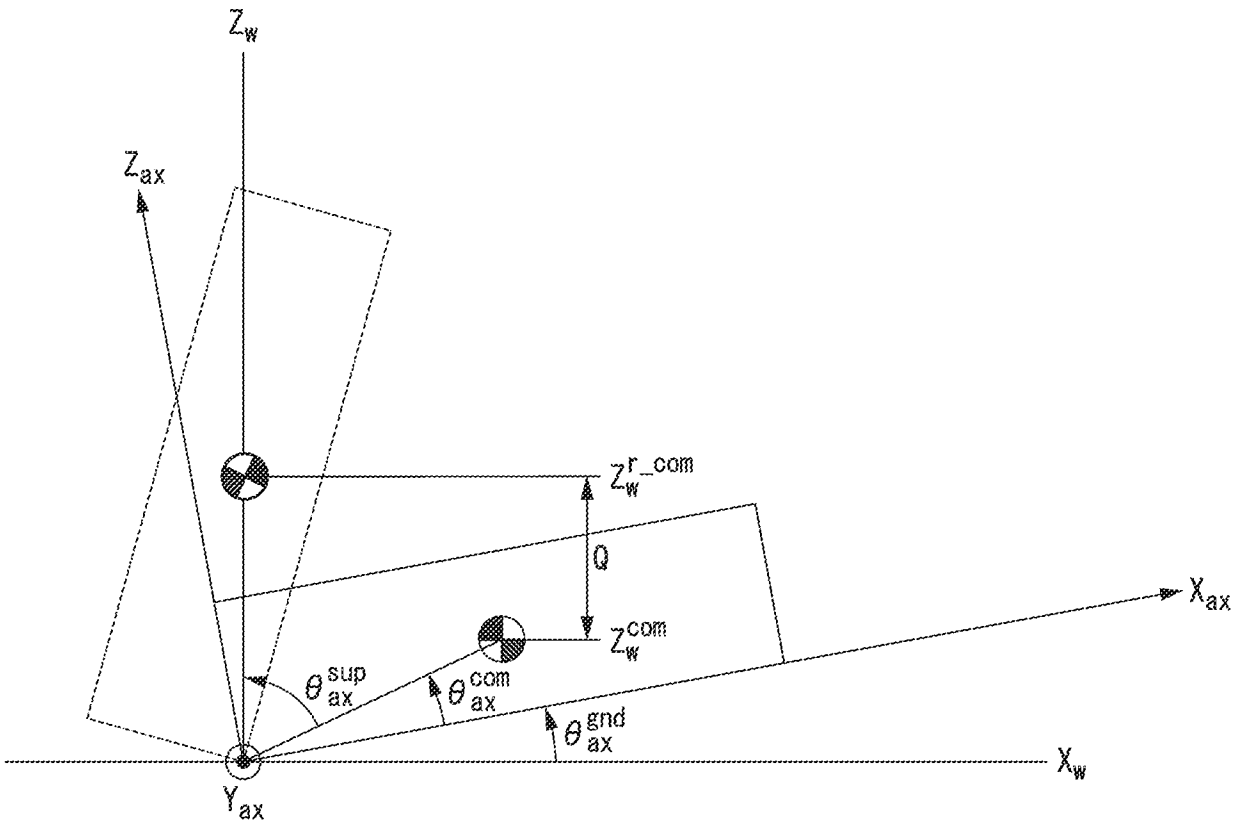
FIG. 3 is a view for explaining an energy stability margin.

The energy calculation unit 214 calculates an energy stability margin, which is an energy amount required to cause the work machine 100 to fall, for each rotation axis based on the center-of-gravity position calculated by the center-of-gravity calculation unit 213. The energy stability margin is an amount represented by Equation (9). FIG. 3 is a view for explaining the energy stability margin.

Equation 9

$$E=QMg$$

$$Q=z_w{}^{r_com}-z_w{}^{com} \tag{9}$$

Namely, the energy stability margin is obtained by multiplying a difference Q between a height $z^{com}{}_w$ of the center of gravity of the work machine 100 and a height $z^{r_com}{}_w$ of the center of gravity when the center of gravity of the work machine 100 is located directly above a rotation axis, a weight M of the work machine 100, and a gravitational acceleration g.

The energy calculation unit 214 obtains the energy stability margin with each side of the support rectangle R as rotation axes ax1 to ax4, the support rectangle R encompassing the ground contact points of the undercarriage 110.

In the case of considering a rotation axis coordinate system in which a rotation axis is an $X_{ax}$ axis, an axis extending in the vertical direction is a $Z_{ax}$ axis, and an axis orthogonal to the $X_{ax}$ axis and the $Z_{ax}$ axis is a $Y_{ax}$ axis, rotation axis-world transformation matrixes $T^{ax1}{}_w$ to $T^{ax4}{}_w$ for transforming from the rotation axis coordinate system to the world coordinate system are represented by Equation (10) using the length L of the endless tracks of the undercarriage 110, the height h of the endless tracks, and the width w of the endless tracks.

Equation 10

$$T_w^{ax1} = T_w^{tb}\begin{bmatrix} 1 & 0 & 0 & 0 \\ 0 & 1 & 0 & -\frac{w}{2} \\ 0 & 0 & 1 & -h \\ 0 & 0 & 0 & 0 \end{bmatrix} \tag{10}$$

$$T_w^{ax2} = T_w^{tb}\begin{bmatrix} \cos\frac{\pi}{2} & -\sin\frac{\pi}{2} & 0 & \frac{L}{2} \\ \sin\frac{\pi}{2} & \cos\frac{\pi}{2} & 0 & 0 \\ 0 & 0 & 1 & -h \\ 0 & 0 & 0 & 0 \end{bmatrix}$$

$$T_w^{ax3} = T_w^{tb}\begin{bmatrix} \cos\pi & -\sin\pi & 0 & 0 \\ \sin\pi & \cos\pi & 0 & \frac{w}{2} \\ 0 & 0 & 1 & -h \\ 0 & 0 & 0 & 0 \end{bmatrix}$$

$$T_w^{ax4} = T_w^{tb}\begin{bmatrix} \cos\frac{3\pi}{2} & -\sin\frac{3\pi}{2} & 0 & -\frac{L}{2} \\ \sin\frac{3\pi}{2} & \cos\frac{3\pi}{2} & 0 & 0 \\ 0 & 0 & 1 & -h \\ 0 & 0 & 0 & 0 \end{bmatrix}$$

The energy calculation unit 214 calculates an inclination angle $\theta^{gnd}{}_{ax}$ around a rotation axis ax of the ground surface, based on the rotation axis-world transformation matrix $T^{ax}{}_w$ obtained by Equation (10). In addition, the energy calculation unit 214 calculates a relative position $T^{com}{}_{max}$ of the center of gravity of the work machine 100 in the rotation axis coordinate system by obtaining the product of an inverse matrix of the rotation axis-world transformation matrix $T^{ax}{}_w$ and the center-of-gravity position $T^{com}{}_w$ of the entirety of the work machine 100. As shown in Equation (11), the energy calculation unit 214 calculates an elevation angle $\theta^{com}{}_{ax}$ of the center of gravity when viewed from the rotation axis, based on a $Z_{ax}$-axis translational component $z^{com}{}_{ax}$ and a $Y_{ax}$-axis translational component $y^{com}{}_{ax}$ of the relative position $T^{com}{}_{ax}$ of the center of gravity.

Equation 11

$$\theta^{com}{}_{ax}=\text{a tan 2}(y_{ax}{}^{com}, z_{ax}{}^{com}) \tag{11}$$

The function a tan2 (x, y) in Equation (11) is used to obtain a deviation angle of a position (x, y) in the orthogonal coordinate system.

As shown in Equation (12), the energy calculation unit 214 calculates a rotation angle $\theta^{sup}{}_{ax}$ required to locate the center of gravity of the entirety of the work machine 100 directly above the rotation axis, based on the inclination angle $\theta^{gnd}{}_{ax}$ and the elevation angle $\theta^{com}{}_{ax}$ of the center of gravity.

Equation 12

$$\theta_{ax}^{sup} = \frac{\pi}{2} - \theta_{ax}^{gnd} - \theta_{ax}^{com} \tag{12}$$

As shown in Equation (13), the energy calculation unit 214 calculates an absolute position $T^{r_com}{}_w$ of the center of gravity of the entirety of the work machine 100 when the work machine 100 is rotated by the rotation angle $\theta^{sup}{}_{ax}$, based on the relative position $T^{com}{}_{ax}$ of the center of gravity, the rotation angle $\theta^{sup}{}_{ax}$, and the rotation axis-world transformation matrix $T^{ax}{}_w$.

Equation 13

$$T_w^{r_com} = T_w^{ax}\begin{bmatrix}1 & 0 & 0 & 0\\ 0 & \cos\theta_{ax}^{sup} & -\sin\theta_{ax}^{sup} & 0\\ 0 & \sin\theta_{ax}^{sup} & \cos\theta_{ax}^{sup} & 0\\ 0 & 0 & 0 & 1\end{bmatrix}T_{ax}^{com} \quad (13)$$

The energy calculation unit 214 calculates a difference Q between a $Z_w$-axis translational component $z^{r_com}{}_w$ of the absolute position $T^{r_com}{}_w$ of the center of gravity after rotation and a $Z_w$-axis translational component $z^{com}{}_w$ of the absolute position $T^{com}{}_w$ of the center of gravity before rotation, as the energy stability margin. The energy stability margin obtained here is equal to energy normalized to the unit of length. As shown in Equation (7), an unnormalized energy stability margin is obtained by multiplying the difference Q in $Z_w$-axis translational component between the absolute position $T^{r_com}{}_w$ of the center of gravity after rotation and the absolute position $T^{com}{}_w$ of the center of gravity before rotation by the weight of the work machine 100 and the gravitational acceleration. Therefore, calculating the difference Q in $Z_w$-axis translational component between the absolute position $T^{r_com}{}_w$ of the center of gravity after rotation and the absolute position $T^{com}{}_w$ of the center of gravity before rotation is equivalent to calculating the energy stability margin.

The normalization unit 215 obtains a normalized margin (normalized value) by dividing the energy stability margin calculated by the energy calculation unit 214, by the length of another side orthogonal to the side related to the rotation axis. The normalized margin is a dimensionless amount, and indicates the degree of approximation to the state where the work machine 100 is most stable with respect to rotation around the rotation axis. For example, the normalization unit 215 obtains a normalized margin by dividing an energy stability margin when rotating around a side end of the endless track (around the rotation axis ax2 or ax4), by the width w of the endless tracks. In addition, for example, the normalization unit 215 obtains a normalized margin by dividing an energy stability margin when rotating around a straight line connecting front ends or rear ends of the pair of endless tracks (around the rotation axis ax1 or ax3), by the length L of the endless tracks.

Figure 4:
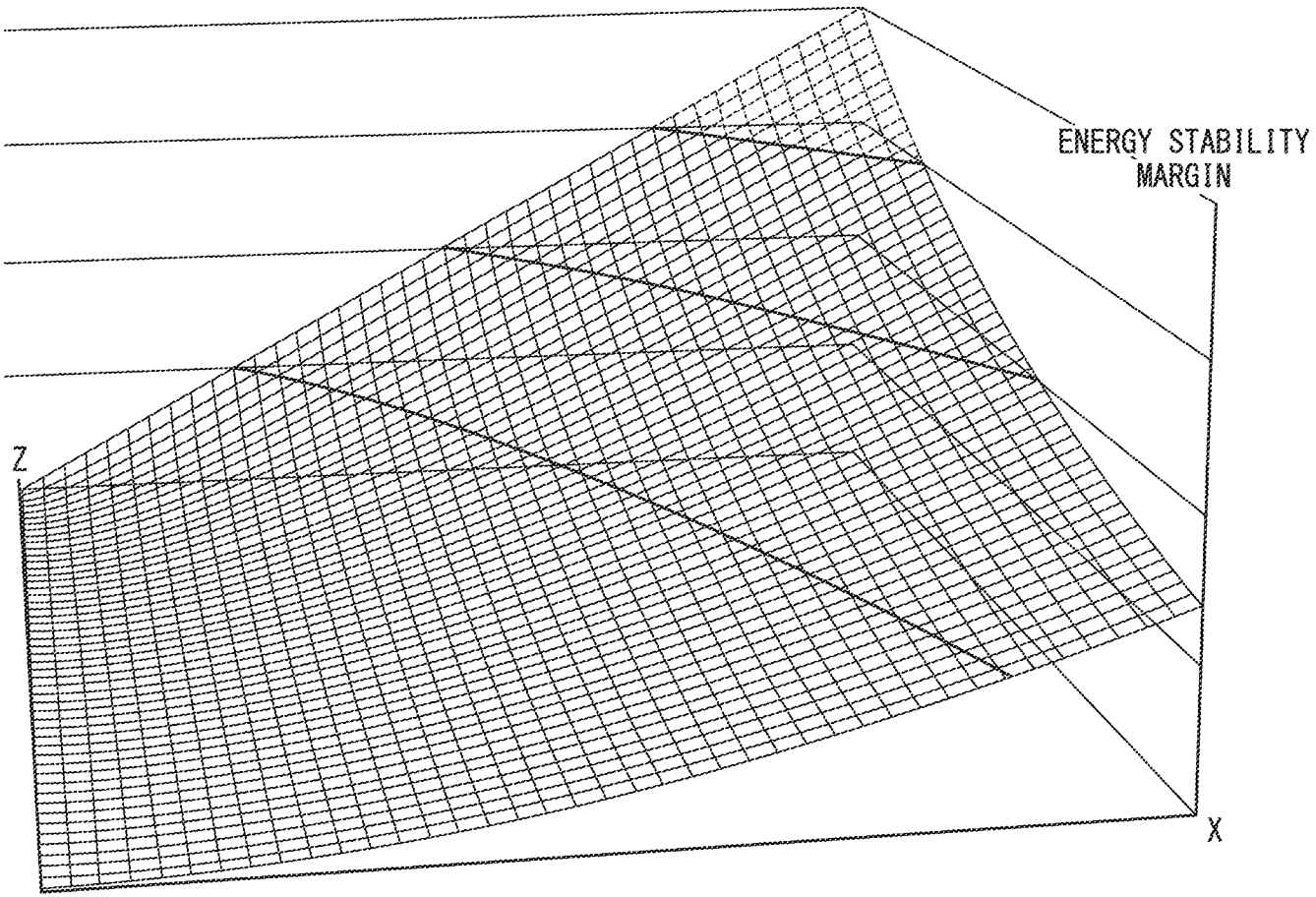
FIG. 4 is a view showing a relationship between the energy stability margin and a center-of-gravity position.

FIG. 4 is a view showing a relationship between the energy stability margin and the energy stability margin and the center-of-gravity position. As shown in FIG. 4, the lower the center-of-gravity position is, the higher the energy stability margin calculated by Equation (7) is, and the farther the distance between the rotation axis and the center of gravity is, the higher the energy stability margin is. Namely, the energy stability margin that the work machine 100 takes for a certain rotation axis is maximized when the center of gravity is located on the support rectangle R and at a point farthest from the rotation axis. Therefore, the energy stability margin can be made dimensionless by dividing the energy stability margin calculated by the energy calculation unit 214, by the length of another side orthogonal to the side related to the rotation axis.

The evaluation unit 216 evaluates the fall risk of the work machine 100 based on the normalized margin calculated by the normalization unit 215. Specifically, the evaluation unit 216 determines whether or not the magnitude of the normalized margin for each rotation axis is larger than a threshold value. Exemplary examples of the threshold value include a caution threshold value the and a warning threshold value $th_w$. However, the caution threshold value the is larger than the warning threshold value $th_w$. In addition, each threshold value is larger than 0 and less than 1.

Figure 5:
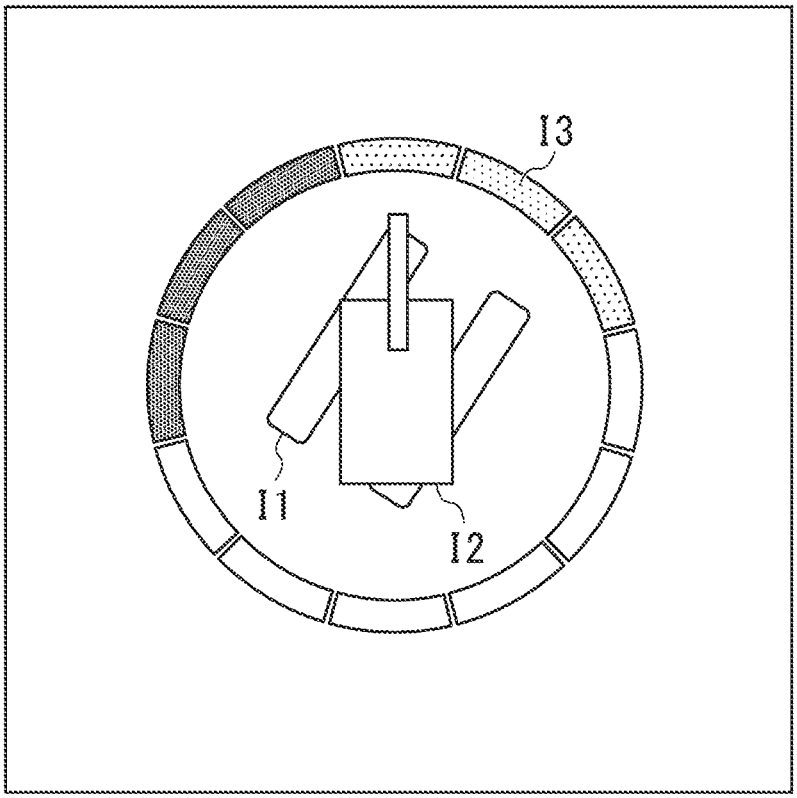
FIG. 5 is a view showing an example of a fall risk sign according to the first embodiment.

The output unit 217 generates a sign that indicates the fall risk of the work machine and that is displayed on a display device of the alarm device, based on the evaluation result of the evaluation unit 216. FIG. 5 is a view showing an example of a fall risk sign according to the first embodiment. An icon I1 of the undercarriage 110, an icon I2 of the swing body 130, and a plurality of indicator marks I3 are displayed on the fall risk sign. The icon I2 of the swing body 130 is always displayed with the front surface (front) facing upward. The icon I1 of the undercarriage 110 is displayed to be inclined according to the swing angle $\theta_s$. The plurality of indicator marks I3 are displayed to surround the icon I2 of the swing body 130. In the example shown in FIG. 5, on the fall risk sign, 12 indicator marks I3 are arranged at equal intervals on a circle centered on the icon I2. The indicator mark I3 indicates the severity of the fall risk in a direction indicated by the indicator mark I3, by changing the color. For example, the indicator mark I3 turns yellow when the fall risk is a caution level, and turns red when the fall risk is a warning level.

The output unit 217 outputs the evaluation result of the evaluation unit 216 to the alarm device. The output unit 217 outputs the generated sign indicating the fall risk of the work machine, to the alarm device. In addition, when the normalized margin for at least one rotation axis is less than the warning threshold value for a certain period of time or more, the output unit 217 outputs an instruction to issue an alarm sound to the alarm device.

Operation of Control Device 190

Figure 6:
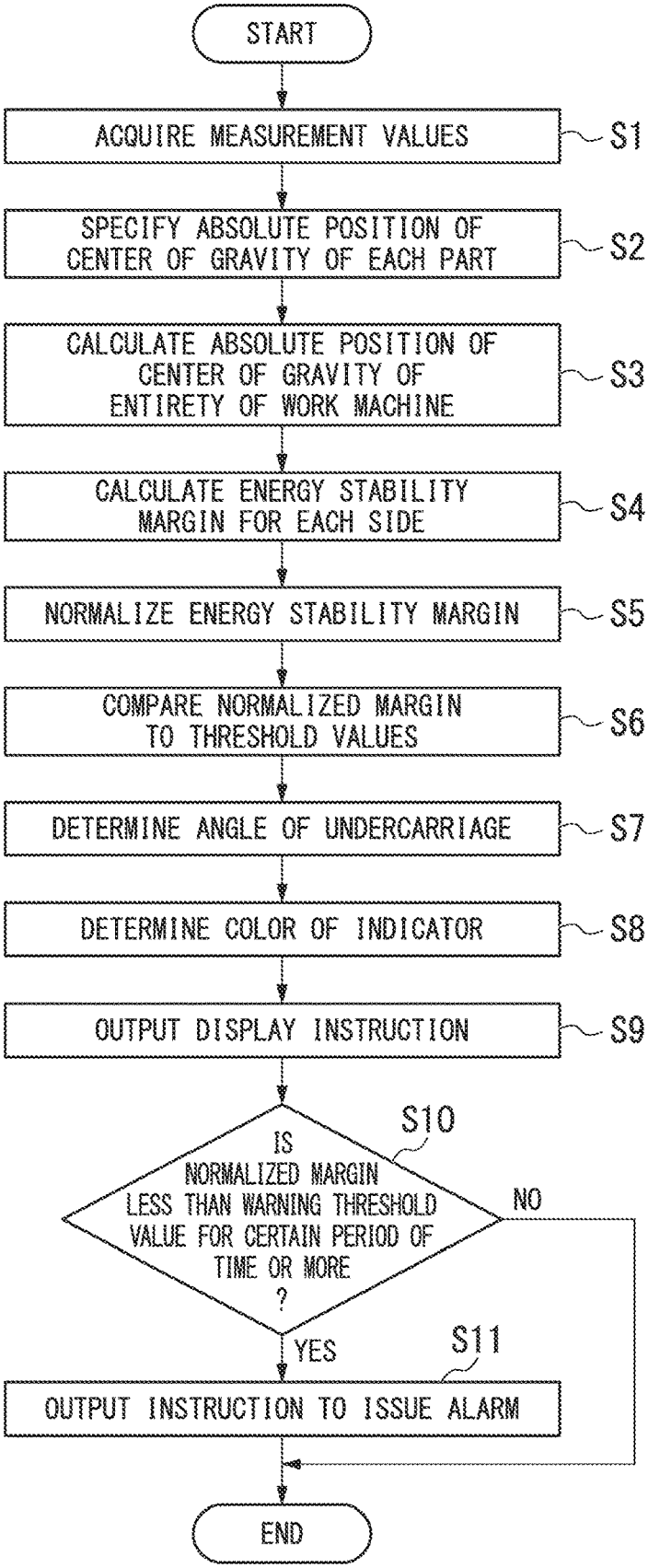
FIG. 6 is a flowchart showing the operation of the control device according to the first embodiment.

FIG. 6 is a flowchart showing the operation of the control device 190 according to the first embodiment.

When the control device 190 starts up and executes the program, the following processes are executed at regular time intervals.

The acquisition unit 211 acquires measurement values from the inclination detector 101, the swing angle sensor 102, the boom angle sensor 103, the arm angle sensor 104, the bucket angle sensor 105, and the payload meter 106 (step S1). The position specifying unit 212 specifies the absolute positions of the centers of gravity of the undercarriage 110, the swing body 130, the boom 151, the arm 152, the bucket 153, and the load, based on the various measurement values acquired in step S1 and on the geometry data recorded in the storage 250 (step S2).

The center-of-gravity calculation unit 213 calculates an absolute position $T^{com}{}_w$ of the center of gravity of the entirety of the work machine 100, based on the absolute position of the center of gravity for each part specified in step S2 and the weight of each part recorded in the storage 250 (step S3). The energy calculation unit 214 calculates a height Q corresponding to the energy stability margin, which is an energy amount required to cause the work machine 100 to fall, for each side of the support rectangle R of the work machine 100, based on the center-of-gravity positions calculated in step S3 (step S4).

The normalization unit 215 obtains a dimensionless normalized margin by dividing the height Q calculated in step S4 by the length of another side orthogonal to the side related to the rotation axis (step S5). The evaluation unit 216 compares the normalized margin for each side calculated in step S5 to the caution threshold value the and the warning threshold value $th_w$ (step S6).

The output unit 217 determines an angle of the icon I1 of the undercarriage 110 on the fall risk sign, based on the measurement value of the swing angle sensor 102 acquired in step S1 (step S7). In addition, the output unit 217 determines a color of each of the indicator marks I3 based on the comparison result in step S6 (step S8). Specifically, the colors of the indicator mark I3 facing the side serving as a rotation axis and of the indicator marks I3 adjacent on both sides of the indicator mark I3 are determined to colors corresponding to the comparison result of the normalized margin related to the rotation axis.

The output unit 217 outputs an instruction to display the generated fall risk sign to the alarm device (step S9). In addition, the output unit 217 determines whether or not the normalized margin for at least one rotation axis is less than the warning threshold value $th_w$ for a certain period of time or more, based on the comparison result in step S6 (step S10). When the normalized margin for at least one rotation axis is less than the warning threshold value $th_w$ for the certain period of time or more (step S10: YES), the output unit 217 outputs an instruction to issue an alarm sound to the alarm device (step S11).

Actions and Effects

As described above, the control device 190 according to the first embodiment evaluates the possibility of the work machine 100 falling for each side of the support rectangle R represented by the convex hull related to the ground contact points of the work machine 100, based on the energy stability margin of the work machine 100 when the side serves as a rotation axis, and on the length of the side of the support rectangle R. Accordingly, the control device 190 can evaluate the possibility of falling in each falling direction in which there is a possibility of falling caused by a swing operation.

Even when the convex hull related to the ground contact points of the work machine 100 is not a rectangular shape, the control device 190 according to another embodiment can evaluate the possibility of falling in the same manner as in the first embodiment, by using the longest distance among distances from the rotation axis to a plurality of vertices of the convex hull.

In addition, the control device 190 according to the first embodiment calculates a normalized margin by dividing the energy stability margin by the length of the side of the support rectangle R. Accordingly, the control device 190 can evaluate the possibility of falling for each side based on the same threshold values (the caution threshold value and the warning threshold value). Since the normalized margin is a dimensionless amount, the control device 190 can perform an evaluation using the same threshold values regardless of individual differences of the work machine 100. The control device 190 according to another embodiment may evaluate an unnormalized energy stability margin by using threshold values obtained by multiplying the length of the side of the support rectangle R.

Second Embodiment

Figure 7:
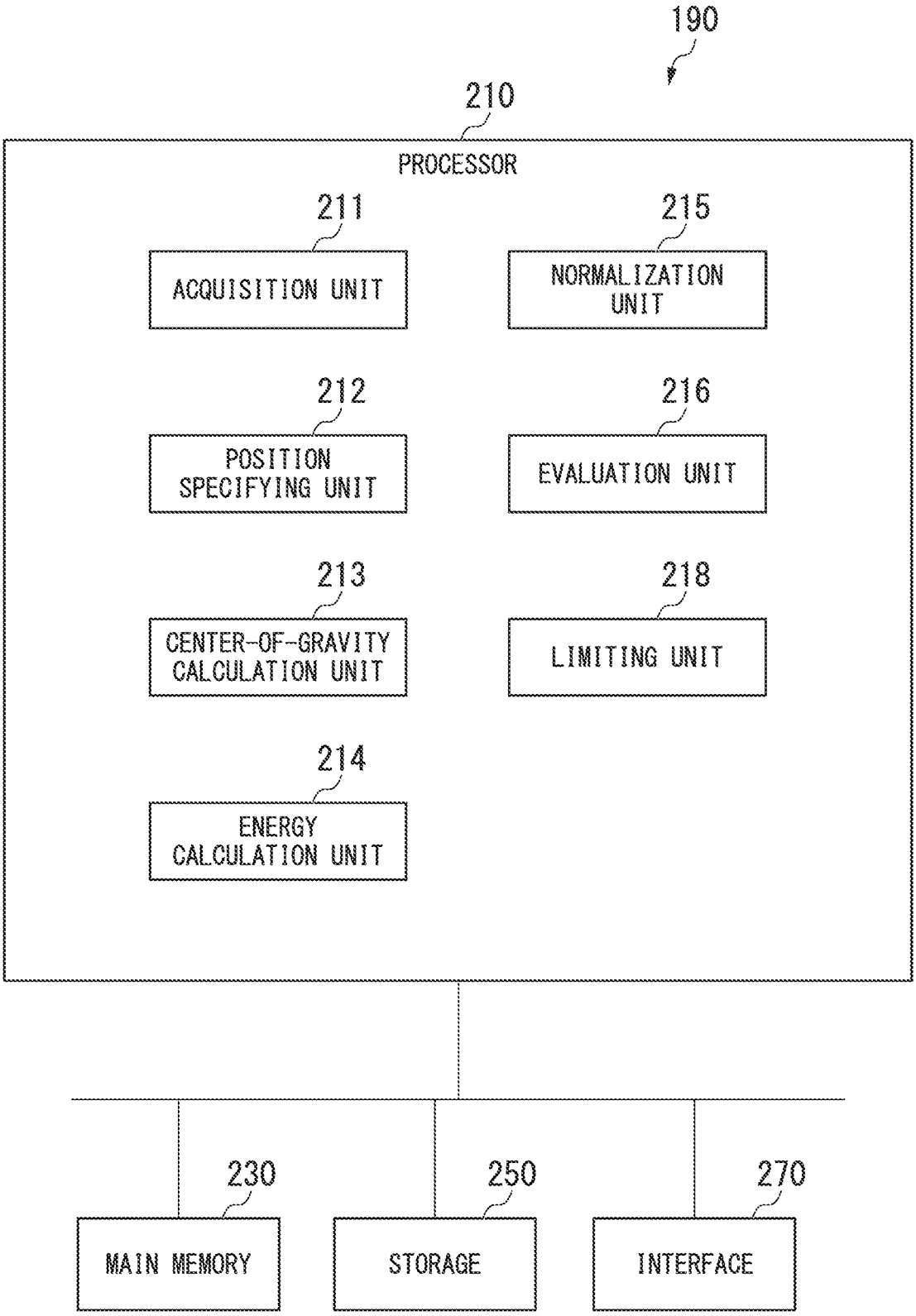
FIG. 7 is a schematic block diagram showing a configuration of a control device according to a second embodiment.

FIG. 7 is a schematic block diagram showing a configuration of the control device 190 according to a second embodiment.

The control device 190 according to the second embodiment includes a limiting unit 218 instead of the output unit 217 of the first embodiment. In addition, the evaluation unit 216 according to the second embodiment may not generate a fall risk sign.

The limiting unit 218 limits the operations of the undercarriage 110, the swing body 130, and the work equipment 150 based on an evaluation result of the evaluation unit 216. For example, when the normalized margin is less than the warning threshold value $th_w$ for a certain period of time or more, the limiting unit 218 stops the undercarriage 110, the swing body 130, and the work equipment 150. Accordingly, the control device 190 can reduce the possibility of falling caused by the operation of the work machine 100.

The limiting unit 218 according to another embodiment may limit the operations by reducing the operation speeds instead of stopping the undercarriage 110, the swing body 130, and the work equipment 150. In addition, the limiting unit 218 according to another embodiment may limit the operation of any one or two of the undercarriage 110, the swing body 130, and the work equipment 150. In this case, when a movable part that is not limited is operated to change the posture of the work machine 100 such that the possibility of the work machine 100 falling is reduced, and thus the normalized margin becomes the warning threshold value $th_w$ or more, the limiting unit 218 releases the operation limit.

Other Embodiments

The embodiments have been described above in detail with reference to the drawings; however, the specific configurations are not limited to the above-described configurations, and various design changes and the like can be made. Namely, in another embodiment, the order of the above-described processes may be appropriately changed. In addition, some of the processes may be executed in parallel.

The control device 190 according to the above-described embodiments may be composed of a single computer, or the configurations of the control device 190 may be divided and disposed in a plurality of computers, and the plurality of computers may cooperate with each other to function as the control device 190. At this time, some computers composing the control device 190 may be mounted inside the work machine 100, and the other computers may be provided outside the work machine 100.

The work machine 100 according to the above-described embodiments includes a speaker and a display device as the alarm device; however, in another embodiment, the work machine 100 is not limited to the configuration, and may include only one of the speaker and the display device. In addition, the alarm device is not limited to the speaker and the display device. For example, the alarm device according to another embodiment may be an actuator provided in the operation device. The actuator may warn the operator by applying a reaction force against an operation of the operation device by the operator. In addition, the actuator may warn the operator by generating vibration in the operation device.

The work machine 100 according to the above-described embodiments is a hydraulic excavator, but is not limited thereto. For example, the work machine 100 according to another embodiment may be a wheel loader or the like including tires instead of endless tracks. In addition, the work machine 100 according to another embodiment may not have a traveling function. In addition, in another embodiment, the support polygon may not be a rectangle. In addition, the work machine 100 according to another embodiment may include an attachment other than the bucket 153, such as a grappler, a breaker, or a crusher.

According to the above aspects, the possibility of the work machine falling can be evaluated in consideration of a relationship between a swing operation and a falling direction.

What is claimed is:

1. A fall evaluation system for a work machine including work equipment, the system comprising:

a processor; and a display, the processor being configured to establish a support polygon based on ground contact points where the work machine contacts a ground surface, the support polygon having a plurality of sides, calculate an energy amount for each of the plurality of sides of the support polygon, the energy amount being an amount of energy required to cause the work machine to fall when each of the plurality of sides serves as a rotation axis, evaluate a possibility of the work machine falling based on the energy amount calculated for each of the plurality of sides, control the display to display an icon representing an appearance of the work machine and a plurality of indicator marks arranged to surround a periphery of the icon, upon determining that there is a side among the plurality of sides for which the energy amount is smaller than a threshold value, control the display such that at least one indicator mark among the plurality of indicator marks is displayed in a different mode than other indicator marks among the plurality of indicator marks, the at least one indicator mark being disposed in a position corresponding to the side for which the energy amount is smaller than the threshold value.

2. The fall evaluation system according to claim 1, wherein the processor is further configured to calculate a center-of-gravity position of the work machine, and calculate the energy amount for each of the plurality of sides based on the center-of-gravity position of the work machine.

3. The fall evaluation system according to claim 1, wherein the support polygon is a convex hull of the ground contact points, and the processor is further configured to evaluate the possibility of the work machine falling based on a longest distance among distances from each of the plurality of sides of the support polygon to a plurality of vertices of the convex hull.

4. The fall evaluation system according to claim 1, wherein the support polygon is a rectangle, and the the processor is further configured to evaluate the possibility of the work machine falling based on the energy amount for each of the plurality of sides and a length of a side orthogonal to each of the plurality of sides.

5. The fall evaluation system according to claim 1, wherein the support polygon is a convex hull of the ground contact points, and the processor is configured to evaluate the possibility of the work machine falling by comparing a normalized value to a threshold value, the normalized value being obtained by dividing the energy amount for each of the plurality of sides of the support polygon by a longest distance among a plurality of distances from each of the plurality of sides to a plurality of vertices of the convex hull.

6. A fall evaluation system for a work machine including work equipment, the system comprising:

a processor configured to establish a support polygon based on ground contact points where the work machine contacts a ground surface, the support polygon having a plurality of sides, calculate an energy amount for each of the plurality of sides of the support polygon, the energy amount being an amount of energy required to cause the work machine to fall when each of the plurality of sides serves as a rotation axis, evaluate a possibility of the work machine falling based on the energy amount calculated for each of the plurality of sides, and control the work machine to stop an operation of the work machine upon determining that there is a side among the plurality of sides for which the energy amount is smaller than a threshold value.

7. A fall evaluation method comprising:

using a processor to establish a support polygon based on ground contact points where a work machine including work equipment contacts a ground surface, the support polygon having a plurality of sides, calculate an energy amount for each of the plurality of sides of the support polygon, the energy amount being an amount of energy required to cause the work machine to fall when each of the plurality of sides serves as a rotation axis, evaluate a possibility of the work machine falling based on the energy amount calculated for each of the plurality of sides, control the display to display an icon representing an appearance of the work machine and a plurality of indicator marks arranged to surround a periphery of the icon, and upon determining that there is a side among the plurality of sides for which the energy amount is smaller than a threshold value, control the display such that at least one indicator mark among the plurality of indicator marks is displayed in a different mode than other indicator marks among the plurality of indicator marks, the at least one indicator mark being disposed in a position corresponding to the side for which the energy amount is smaller than the threshold value.

8. A work machine comprising:

an undercarriage;

a swing body that is rotatably supported by the undercarriage;

work equipment attached to the swing body;

a display; and a processor, the processor being configured to calculate a center-of-gravity position of the work machine, establish a support polygon of the undercarriage based on ground contact points where the work machine contacts a ground surface, the support polygon having a plurality of sides, calculate an energy amount for each of the plurality of sides of the support polygon based on the center-of-gravity position of the work machine, the energy amount being an amount of energy required to cause the work machine to fall when each of the plurality of sides serves as a rotation axis, and evaluate a possibility of the work machine falling based on the energy amount calculated for each of the plurality of sides, control the display to display an icon representing an appearance of the work machine and a plurality of indicator marks arranged to surround a periphery of the icon, and upon determining that there is a side among the plurality of sides for which the energy amount is smaller than a threshold value, control the display such that at least one indicator mark among the plurality of indicator marks is displayed in a different mode than other indicator marks among the plurality of indicator marks, the at least one indicator mark being disposed in a position corresponding to the side for which the energy amount is smaller than the threshold value.

* * * * *